US005235714A

United States Patent [19]

Toso

[11] Patent Number: 5,235,714

[45] Date of Patent: Aug. 17, 1993

[54] COMBINATION STRETCHING AND BACK SUPPORT DEVICE

[76] Inventor: Victor Toso, 2438 Como Ave., SE., St. Paul, Minn. 55108

[21] Appl. No.: 981,535

[22] Filed: Nov. 25, 1992

[51] Int. Cl.[5] ..... A47C 20/00

[52] U.S. Cl. ..... 5/657; 5/633; 602/36

[58] Field of Search ..... 5/652, 657, 624, 653, 5/633, 621, 648; 297/465, 485, 466; 602/23, 24, 25, 36; 128/78

[56] References Cited

U.S. PATENT DOCUMENTS

| | | | |
|---|---|---|---|
| 1,015,812 | 6/1912 | Madsen | 5/633 |
| 1,266,374 | 5/1918 | Ziegler | 5/633 |
| 2,741,412 | 4/1956 | Hinkle | 297/485 |
| 4,422,454 | 12/1983 | English | 5/633 |
| 4,913,136 | 4/1990 | Chong | 602/24 |
| 4,934,005 | 6/1990 | Mortin | 5/652 |
| 5,167,203 | 12/1992 | Scott | 297/485 |

FOREIGN PATENT DOCUMENTS

| | | | |
|---|---|---|---|
| 28347 | 10/1930 | Australia | 5/633 |

*Primary Examiner*—Peter M. Cuomo
*Assistant Examiner*—Flemming Soether
*Attorney, Agent, or Firm*—Aquilino & Welsh

[57] ABSTRACT

A combination back support for use during stretching and/or sitting with the legs extended/not extended. The device includes a substantially rectangular lumbar back support with a multiplicity of pairs of inelastic straps configured in a first configuration to engage the feet of the user and in an alternative configuration to engage the knees of the user. When the user is in one of the various seated positions, the straps are connected to form loops which are fitted over either the feet or knees of the user. As the user applies pressure with the feet or knees, the lumbar rectangular support is pulled tight around the user's lower back, providing ample support.

12 Claims, 6 Drawing Sheets

COMBINATION STRETCHING AND BACK SUPPORT DEVICE

BACKGROUND OF THE INVENTION

1. Field of the Invention

The present invention relates to back support devices, and in particular to a device which combines stretching exercise movements and seated back support in a single device.

2. Description of the Prior Art

As described in my previous U.S. Pat. No. 4,773,106, when an individual is seated upright on a flat surface without a back support, such a position becomes uncomfortable due to the lack of support at the lumbar region. This is particularly true for people with poor posture and/or a weak back structure. For people who sit in upright positions for long periods of time, the back support disclosed in the aforementioned patent used a padded back support sized to fit the lumbar region of a user connected to a pair of inelastic straps which extend from the ends of the support and terminate in loops to engage the knees of the user. The pressure of the user's knees and legs pulls the support member against the lumbar region, thereby providing sufficient support to enable the user to sit in upright positions for extended periods. Athletes who perform various stretching exercises have a need for back support throughout the entire stretching motion. Heretofore the prior art has failed to provide adequate back support for the various positions necessary for a proper stretching program as is provided by the present invention.

Additional prior art includes my U.S. Pat. Nos. 5,083,554 and 4,813,080 and patents to Wildermuth (U.S. Pat. No. 2,280,274) and Stevens (U.S. Pat. No. 3,295,517). The prior art references fail to provide for a device which provides back support while performing stretching exercising. The references further fail to provide for a multiconfigurable device which provides back support while in a plurality of positions: seated with the legs extended, seated with the legs crossed and/or in the usual upright seated position. Additionally, none of the prior art systems have the strap and buckle configuration of the present invention.

SUMMARY OF THE INVENTION

A general object of the invention is to provide a method of sitting with the legs out-stretched while providing comfortable back support.

Additionally it is an object of the invention to provide a manner of stretching muscles that are difficult to stretch without compromising the lumbar spine in the process.

Another object of the invention is to provide adequate adjustability in all features to make the present invention fit to all sizes.

The present invention includes a substantially rectangular lumbar back support with a multiplicity of pairs of inelastic straps configured in a first configuration to engage the feet of the user and in an alternative configuration to engage the knees of the user. When the user is in one of the various seated positions the straps are connected to form loops which are fitted over either the feet or knees of the user. As the user applies pressure with the feet or knees, the lumbar rectangular support is pulled tight around the user's lower back providing ample support.

The invention keeps the lumbar spine supported such that it will not be compromised by the required muscular effort used to stretch by leaning forward. In addition, the device will allow greater hamstring stretching while leaning backwards.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
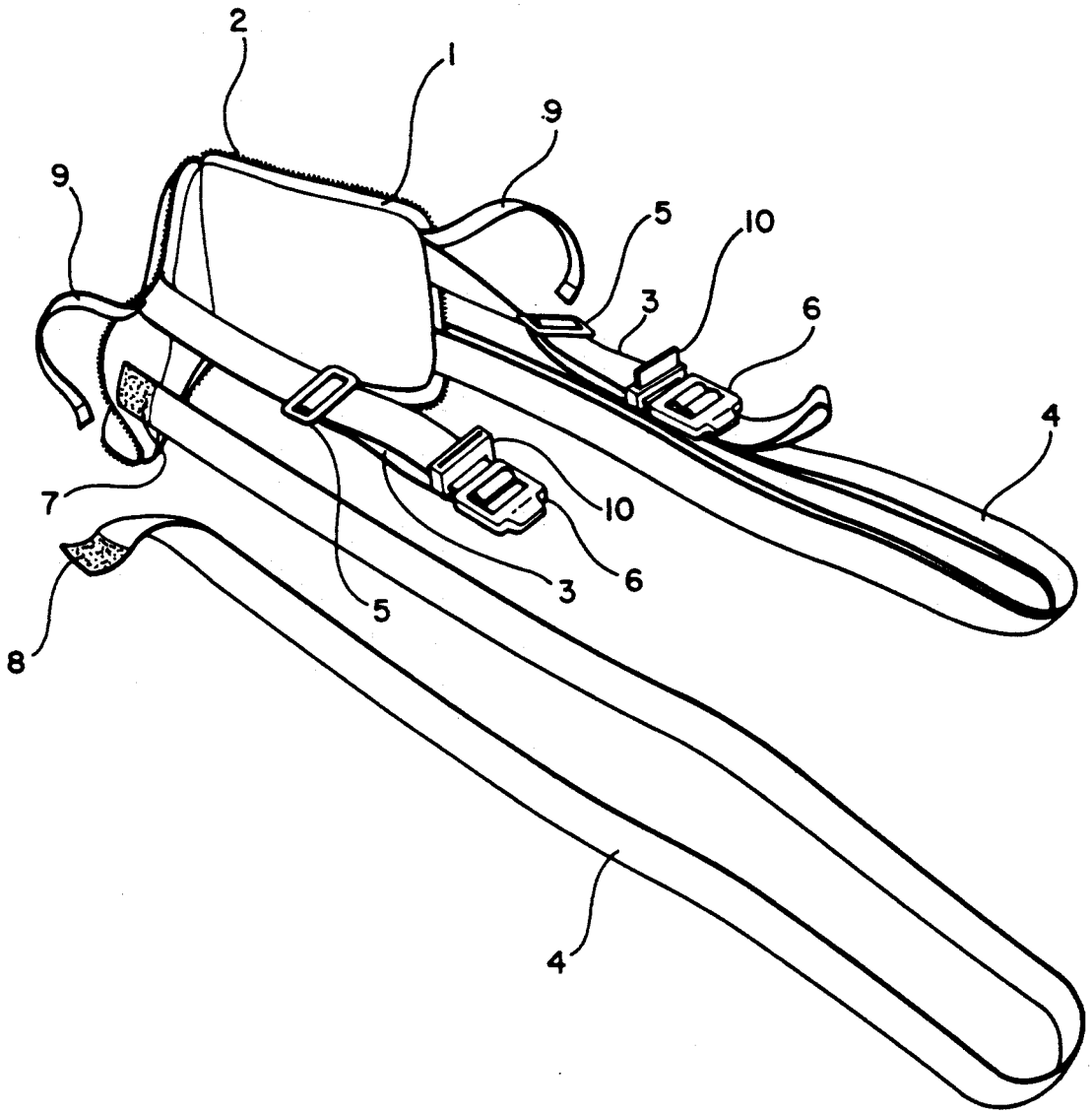
FIG. 1 is a perspective view of the present invention with differing strap configurations.

FIG. 1 shows the present invention with the straps 3 and 4 configured in two different arrangements—connected and not connected respectively. The device consists of a padded back support 1 which is shaped to wrap around the lower back portion of the user and provides support to the lumbar region. In this embodiment, the back support 1 is formed of a unitary, double-ended, flexible, and substantially rectangular member. The back support includes an interior section (not shown) containing a series of longitudinally directed belts (not shown) providing support which are preferably made of a strong fabric material such as canvas or a belting material. The interior section further includes a foam pad (not shown) which extends substantially the length and width of the support. The interior section is covered by a flexible fabric material which is fit over and secured by sewing. A further description of a typical support member may be found in my prior U.S. Pat. No. 4,773,106, which is hereby incorporated by reference.

An identical pair of straps, elements 3 and 4, extend from each end of the back support 1 and are attached to the ends of the support 1 by a suitable conventional means such as sewing or the like. Alternatively, the straps 3 and 4 may be integral extensions from each end of support 1. Strap 3 has three buckles 5, 6 and 10. Buckle 5 is preferably a tri-slide buckle used for adjusting the length of strap 3 so as to position the buckle 6 in a comfortable position for the user. Buckle 6 is a ladder-lock adjustment buckle for engaging the end of strap 4 and allowing adjustment thereof. Buckle 10 is a "snap-in" type fastener which can be connected to its paired buckle on the opposite strap 3. The specific buckles cited are for the preferred embodiment. It should be recognized that any suitable and functionally equivalent buckles could be used. Each of the respective straps 4 has a velcro fastener 8 which is used to fasten the end of the strap 4 to the support 1 at a velcro receptor patch 7. This attachment could be embodied in various forms such as a multiple configuration of side release buckles or the like. Straps 9 are connected together to attach the device while in the standing position. The support has a zipper edge 2 used for enclosing the device as will be described hereafter.

Figure 2:
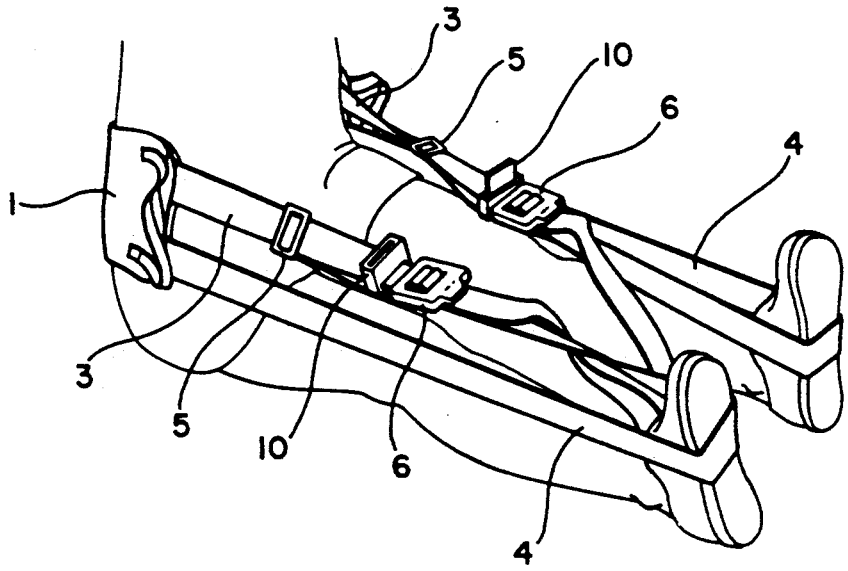
FIG. 2 is a perspective view of the present invention configured as a stretching aid.

FIG. 2 shows the device configured in the preferred embodiment. The straps 4 are fed through their respective buckles 6 and adjusted to a length which would allow them to loop around the feet of the user. In this configuration, the user could perform a variety of stretching exercises while maintaining full lower back support.

Figure 3:
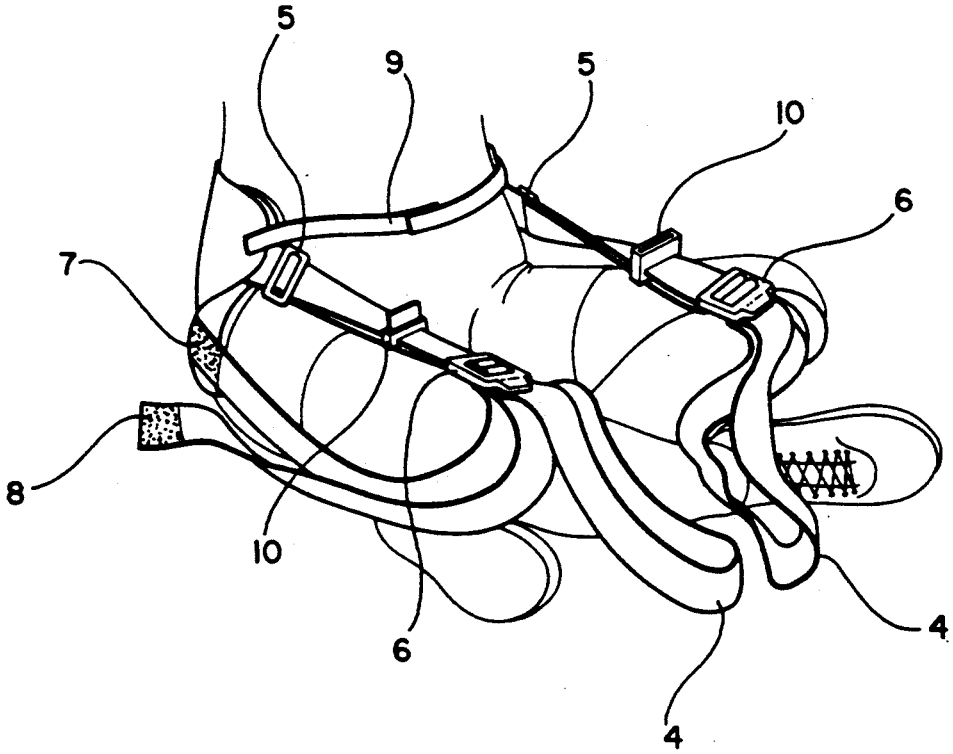
FIG. 3 is a perspective view of the present invention configured as a sitting back support.

FIG. 3 shows the device configured in an optional sitting arrangement with the legs not extended. In this configuration, each of the straps 4 are folded in half and fed through their respective buckles 6. The loose end of the straps 4 are connected (not shown) with their respective velcro fasteners 7 and 8. The folded straps provide for two distinct straps extending from buckle 6 which are separated across the knees of the user to provide for maximal dispersion of pressure over the shin area. This Figure shows the snap-in buckles 10 not connected.

Figure 4:
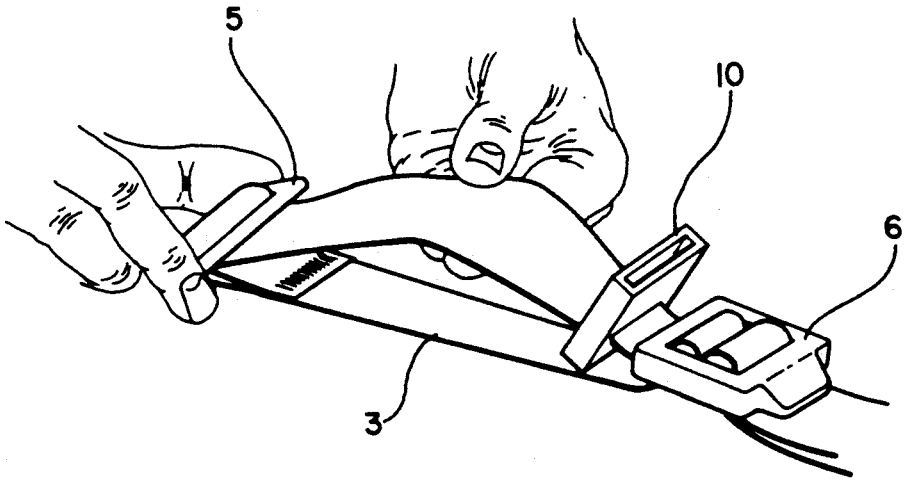
FIG. 4 is a perspective view of the present invention showing the strap-buckle configuration.
Figure 5:
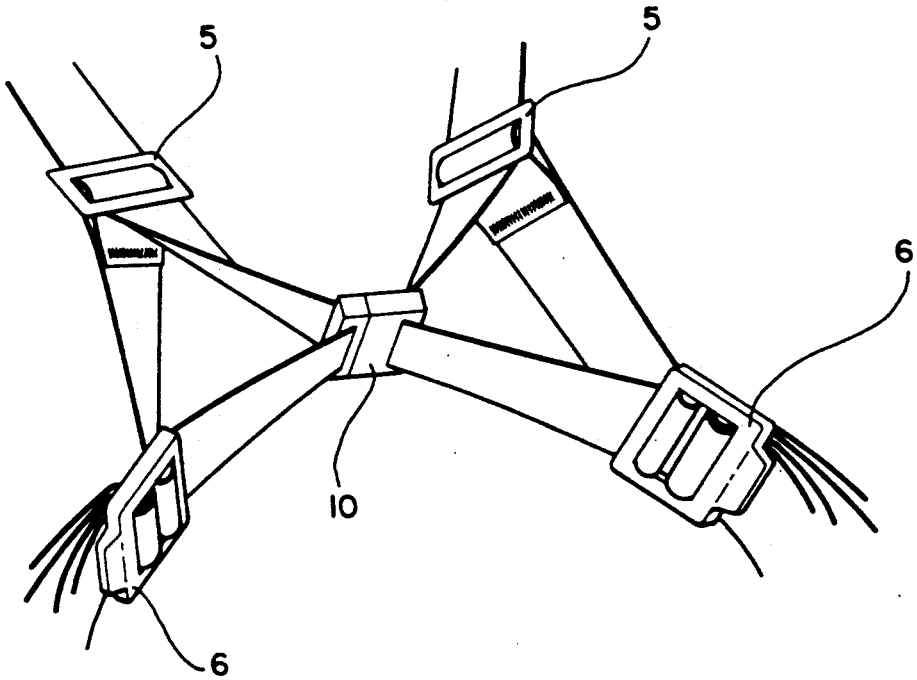
FIG. 5 is a close-up perspective view of the connections as per FIG. 8.

FIGS. 4 and 5 show close-up views of the buckle strap configurations. In FIG. 5 the snap-in buckles 10 have been connected. This connection prevents the user from separating their legs beyond a selectable limit.

Figure 6:
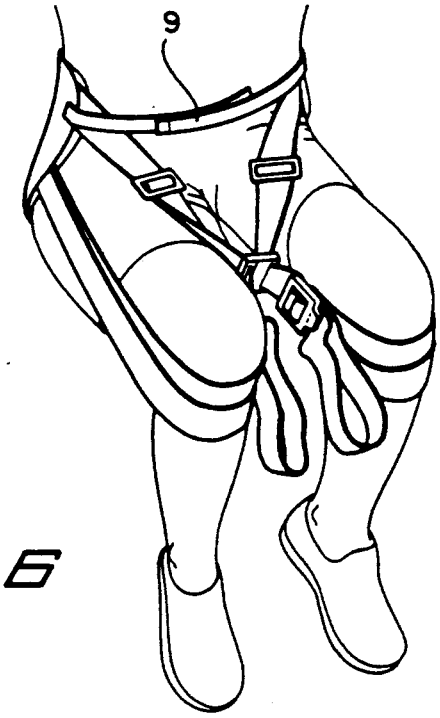
FIG. 6 is a perspective view of the present invention configured as a sitting back support with the pair of straps connected.
Figure 7:
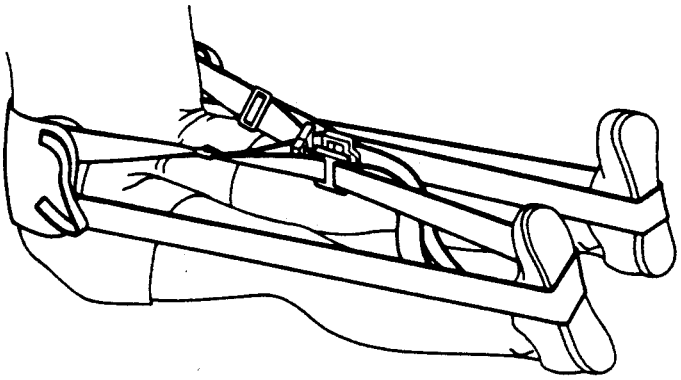
FIG. 7 is a perspective view of the present invention configured as a stretching aid with the pair of straps connected.
Figure 8:
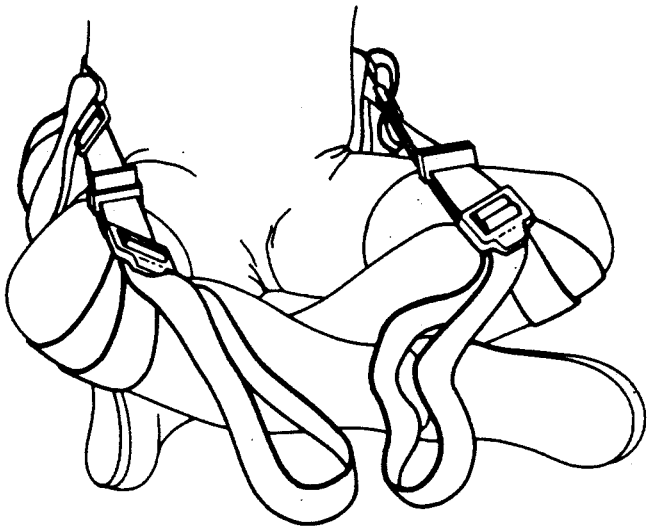
FIG. 8 is a frontal perspective view of the present invention used in the sitting cross-legged position.
Figure 9:
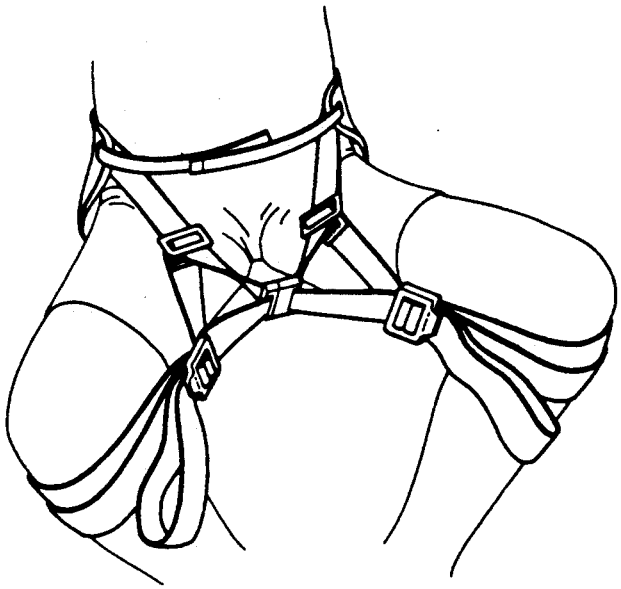
FIG. 9 is a frontal perspective view of the present invention used in the sitting cross-legged position with the straps connected.
Figure 10:
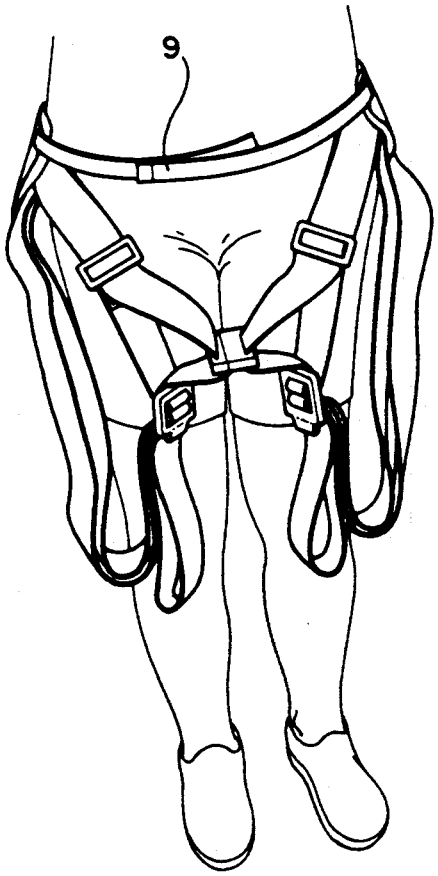
FIG. 10 is a frontal perspective view of the present invention and its associated attachment when configured in the standing position.

FIGS. 6–10 show various possible configurations of the present invention. In FIG. 6 the user is in a upright seated position with the snap-in buckles 10 attached and the waist strap 9 attached. In FIG. 7 the user is seated as in FIG. 2 but with the snap-in buckles 10 attached. FIG. 8 shows the user seated as in FIG. 3 and is included to demonstrate a close-up view of the double straps across the knees as previously described. In FIG. 9, the user is seated with the legs separated but limited in outward mobility by the connecter 10. FIG. 10 demonstrates how the device remains attached while standing by connection of strap 9.

Figure 11:
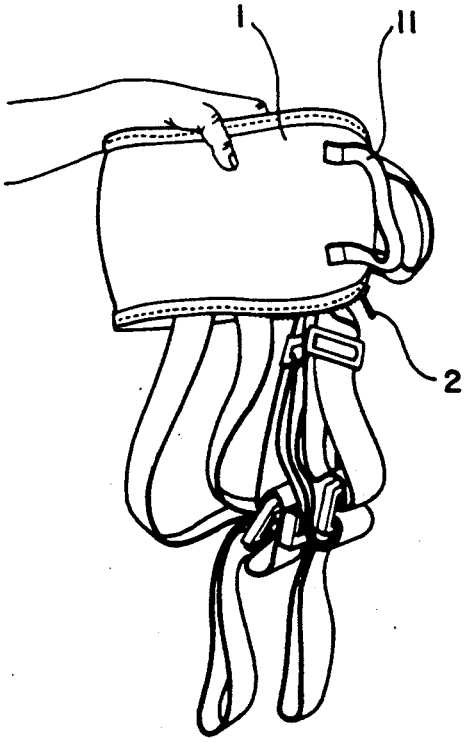
FIG. 11 shows the present invention being put into the back piece to become a carrying case.

FIG. 11 shows how the entire device may be encapsulated into the support 1. The support is folded in half and the straps with their respective buckles are placed inside. After the straps and buckles are placed inside the support 1 it is enclosed by zipper 2. Handles 11 provide a means to easily carry the device after it is fully closed. The support 1 is dimensioned to have a length which extends around the lower back of the user and a width which extends the height of the lumbar region.

In an alternative embodiment, the present invention may be incorporated into an upper torso garment as shown in my U.S. Pat. No. 4,813,080, entitled UPPER TORSO GARMENT WITH INTEGRAL BACK SUPPORT, hereby incorporated by reference. In this embodiment, (see FIG. 12) the stretch straps would be accessible from the interior of the garment and the support structure would be integral with the garment.

While various preferred embodiments have been shown and described, it will be understood that there is no intent to limit the invention by such disclosure, but rather, is intended to cover all modifications and alternate constructions falling within the spirit and scope of the invention as defined in the appended claims. The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

I claim:

1. A support device for supporting the lower back region of a user while performing stretching exercises in a seated position with legs extended comprising:

a double-ended, flexible, substantially rectangular, back support member having a length substantially spanning the width of the lower back of said user and a width substantially spanning the height of the lumbar portion of said user;

two pairs of elongated straps each of said straps having a proximal end and a distal end;

said pairs of straps attached by their proximal ends to one end of said double-ended, back-supporting member; a first strap of each of said pairs of straps forming a first loop and the remaining strap of said pair forming a second loop when connected to the distal end of said first strap loop; said second loop being of such a length to engage the feet of said user;

a first pair of buckles for coupling and adjusting the size of each of said first loops;

a second pair of buckles for simultaneously coupling and adjusting the size of each of said second loops;

a third pair of buckles for coupling each of said first loops together;

whereby the force of said user's feet on said straps pulls said back supporting member against the lower back of said user to provide support and comfort while in the seated position with the legs extended.

2. A support device as per claim 1, wherein each of said first buckles comprises a slide adjuster that allows shortening or lengthening of the distance of each of said second buckles from the user's torso and each of said second and third buckles comprise a ladder lock attachment and a leg-lock coupler, respectively.

3. A support device as per claim 1, wherein said support device is incorporated into and made integral with an upper torso garment.

4. An adjustable back support device for supporting the lower back region of a user either in a seated position or in a seated position with the legs extended comprising:

a double-ended, flexible, substantially rectangular, back support member having a length substantially spanning the width of the lower back of said user and a width substantially spanning the height of the lumbar portion of said user;

two pairs of elongated straps each of said straps having a proximal end and a distal end;

said pairs of straps attached by their proximal ends to one end of said double-ended, back-supporting member; a first strap of each of said pairs of straps forming a first loop and the remaining strap of said pair forming a second loop when connected to the distal end of said first strap loop;

a first pair of buckles for coupling and adjusting the size of each of said first loops;

a second pair of buckles for simultaneously coupling and adjusting the size of each of said second loops;

wherein adjusting said buckles in a first manner provides for said second loop to be of a length to engage the knees of said user and adjusting said buckles in a second manner provides for said second loop to be of a length to engage the feet of said user;

whereby the force of said user's knees or feet on said straps pulls said back supporting member against the lower back of said user to provide support and comfort while in the seated position with the legs extended.

5. A support device as per claim 4, wherein said device is used to provide back support while performing stretching exercises.

6. A support device as per claim 4 wherein each of said first buckles comprises a slide adjuster that allows shortening or lengthening of the distance of each of said second buckles from the user's torso and each of said second buckles comprises a ladder lock attachment.

7. A support device as per claim 6, wherein said adjusting of said buckles in said first manner comprises folding each of said long straps in half and feeding them through their respective second buckle and thereafter attaching the distal end to the point where the proximal end is attached to said back supporting member.

8. A support device as per claim 7, wherein said distal end of each of said long straps further comprises a velcro attaching means for making said distal end attachment.

9. A support device as per claim 7 wherein each of said folded long straps is separated at the knee to allow for dispersement of pressure around the knee.

10. A support device as per claim 4, wherein said pairs of straps each comprise a short strap and a long strap.

11. A support device as per claim 4, further comprising a third buckle located on each of said first loops for connecting together each of said first loops to hold the legs of the user to a minimum separation.

12. An adjustable back support device as per claim 4, wherein said adjustable back support device is incorporated into and made integral with an upper torso garment.

* * * * *

UNITED STATES PATENT AND TRADEMARK OFFICE

CERTIFICATE OF CORRECTION

PATENT NO. : 5,235,714

DATED : August 17, 1993

INVENTOR(S) : Victor Toso

Figure 12:
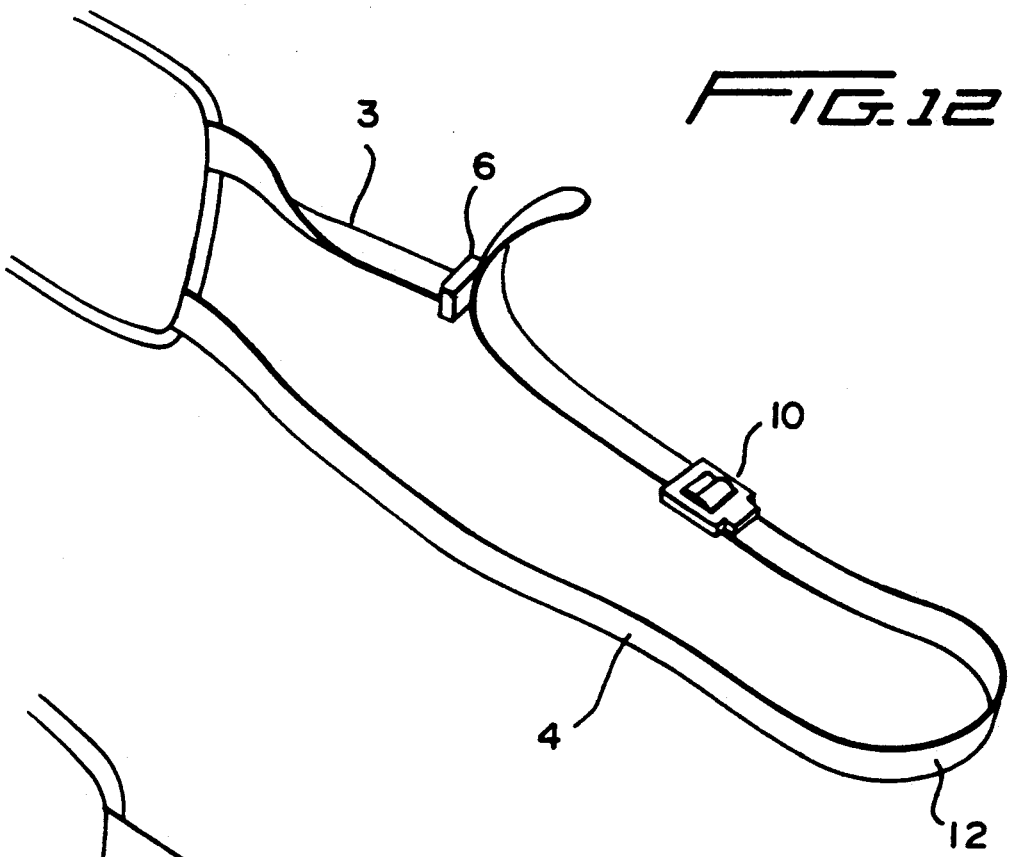
FIG. 12 shows the present invention incorporated into and made integral with an upper torso garment.
Figure 13:
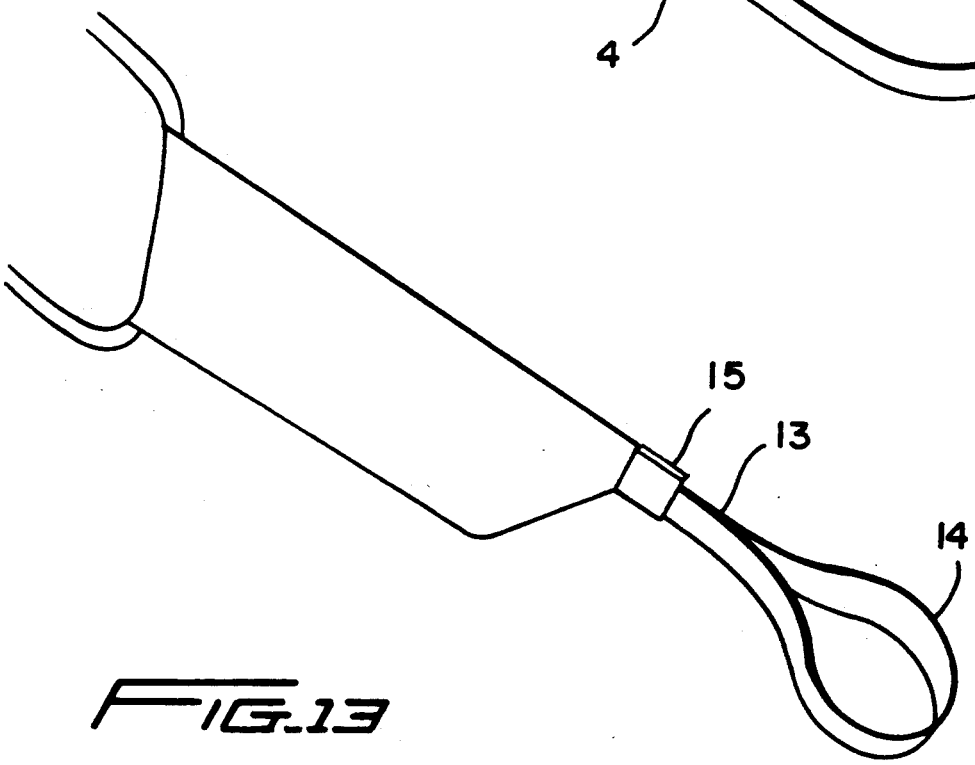
Figure 12:
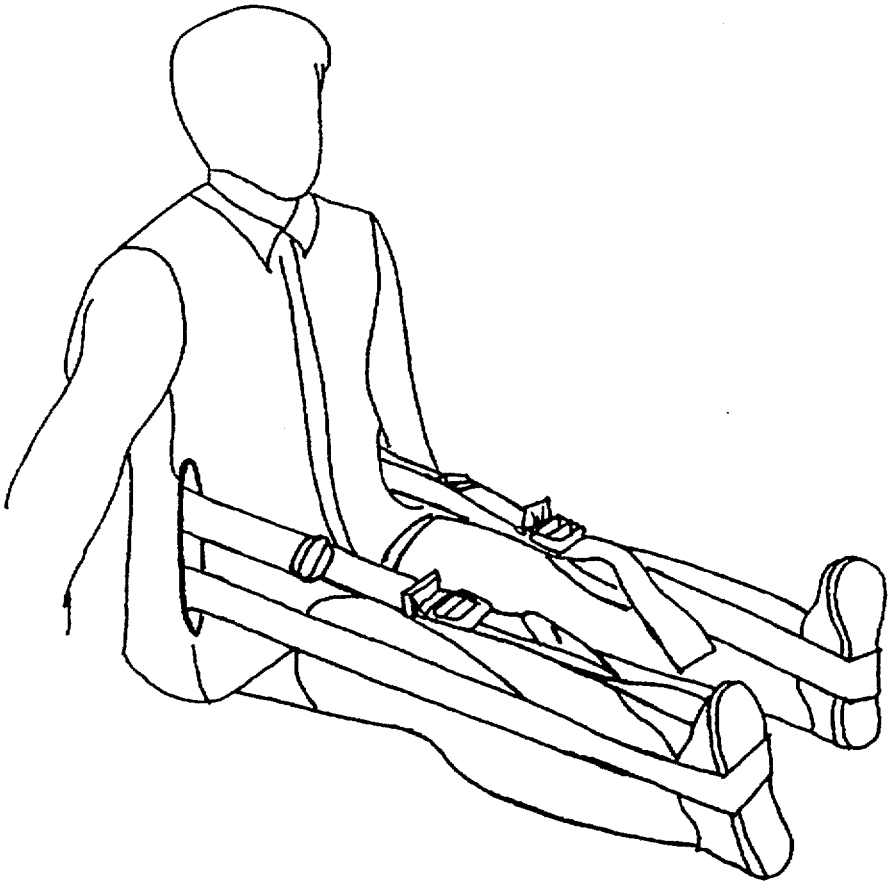

It is certified that error appears in the above-indentified patent and that said Letters Patent is hereby corrected as shown below:

Drawing sheet 6 of 6 should be deleted, and substitute therefor new Drawing sheet 6 of 6, consisting of Fig. 12, as shown on the attached page.

Signed and Sealed this

Twenty-third Day of August, 1994

*Attest:*

Bruce Lehman

BRUCE LEHMAN

*Attesting Officer*

*Commissioner of Patents and Trademarks*